US007750806B1

(12) United States Patent
Skjellerup et al.

(10) Patent No.: US 7,750,806 B1
(45) Date of Patent: Jul. 6, 2010

(54) MAGNETIC SECURITY TAG ASSEMBLY

(76) Inventors: Johan Skjellerup, P.O. Box 811269, Boca Raton, FL (US) 33481; Pu Chen, Rm 1802, Blk 7, No. 801 Wu Ding Rd., Shanghai (CN) 200040

( * ) Notice: Subject to any disclaimer, the term of this patent is extended or adjusted under 35 U.S.C. 154(b) by 290 days.

(21) Appl. No.: 11/891,039

(22) Filed: Aug. 8, 2007

(51) Int. Cl.
*G08B 13/14* (2006.01)

(52) U.S. Cl. ..... 340/568.1; 340/551; 340/572.1; 340/572.3; 340/572.9; 340/5.6; 70/57.1; 70/391; 70/416

(58) Field of Classification Search ..... 340/568.1, 340/551, 572.1, 572.3, 572.9, 825.54, 5.6; 70/57.1, 391, 416
See application file for complete search history.

(56) References Cited

U.S. PATENT DOCUMENTS

| | | | | |
|---|---|---|---|---|
| D205,049 | S | 6/1966 | Brady et al. | |
| 4,510,489 | A | 4/1985 | Anderson, III et al. | |
| D343,134 | S | 1/1994 | Witzky et al. | |
| D343,135 | S | 1/1994 | Witzky et al. | |
| D344,033 | S | 2/1994 | Davidge | |
| 5,347,262 | A * | 9/1994 | Thurmond et al. | 340/572.9 |
| D354,924 | S | 1/1995 | Garner et al. | |
| D410,400 | S | 6/1999 | Skjellerup | |
| 5,942,978 | A | 8/1999 | Shafer | |
| 5,955,951 | A * | 9/1999 | Wischerop et al. | 340/572.8 |
| D455,363 | S | 4/2002 | Fuss | |
| 6,535,130 | B2 * | 3/2003 | Nguyen et al. | 340/572.9 |
| 7,073,236 | B2 * | 7/2006 | Xue et al. | 24/704.1 |
| 7,183,917 | B2 | 2/2007 | Piccoli et al. | |
| 7,382,256 | B2 | 6/2008 | Skjellerup et al. | |
| 7,474,216 | B2 | 1/2009 | Skjellerup et al. | |
| 2004/0070507 | A1 | 4/2004 | Campero | |
| 2008/0291029 | A1 | 11/2008 | Skjellerup et al. | |
| 2009/0128341 | A1 | 5/2009 | Skjellerup et al. | |

FOREIGN PATENT DOCUMENTS

| | | | |
|---|---|---|---|
| BE | 1004849 | A7 | 2/1993 |
| DE | 200 14 860 | U1 | 10/2000 |
| DE | 20 2004 008 789 | U1 | 11/2004 |
| EP | 0 012 923 | A1 | 7/1980 |
| EP | 0 142 748 | A1 | 5/1985 |
| JP | 2006-249364 | A | 9/2006 |
| WO | WO 2004/106674 | A1 | 12/2004 |
| WO | WO 2005/118991 | A1 | 12/2005 |

* cited by examiner

*Primary Examiner*—Tai T Nguyen
(74) *Attorney, Agent, or Firm*—Malloy & Malloy, P.A.

(57) ABSTRACT

A security tag assembly structured to discourage unauthorized removal of merchandise comprising a base including at least one magnetomechanical member normally operatively oriented in an armed mode. The armed mode is at least partially defined by the magnetomechanical member demonstrating a vibration or mechanical resonance when exposed to a predetermined resonant frequency, such as when passing through or otherwise disposed in proximity to a monitoring alarm assembly. A stabilizing assembly comprising at least one stabilizing magnet is disposed and structured to expose said magnetomechanical member to a stabilizing magnet field sufficient operative characteristics to facilitate restoration or maintenance of the armed mode of the magnetomechanical member even when exposed to a disruptive magnetic field, such as when the magnetomechanical member is attempting to be disarmed by an unauthorized source.

12 Claims, 12 Drawing Sheets

MAGNETIC SECURITY TAG ASSEMBLY

BACKGROUND OF THE INVENTION

1. Field of the Invention

This invention is directed to a security tag assembly structured to discourage unauthorized removal of merchandise and which includes a base and a connecting portion collectively structured to be removably attached to the merchandise. At least one magnetomechanical member disposed on the base is structured to assume an armed mode allowing it to demonstrate a mechanical resonance or vibration when exposed to a predetermined resonant frequency, of the type emitted by monitoring/alarm system. A stabilizing assembly preferably comprising at least one stabilizing magnet is disposed on the base in predetermined proximity to the magnetomechanical member so as to maintain or restore the armed mode, even when the tag assembly is subjected to an unauthorized, disruptive magnetic field.

2. Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacturer or provider can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

The present invention is directed to a magnetic security tag assembly structured to be connected to different types of merchandise in an operative position. When so connected, the structural and operative components of the security tag assembly prevents or at least restricts the unauthorized removal of the merchandise from a given area. Accordingly, the security tag assembly of the present invention is perhaps the most commonly, but not exclusively, used and/or identified with retail sales outlets, wherein attempted theft of various merchandise or products, commonly termed "shoplifting", is commonplace. In order to prevent such illegal activity, the security tag assembly of the present invention is attachable to the protected merchandise in an efficient manner without causing damage thereto.

In addition, various structural and operative features of the preferred embodiments of the present invention provide for the authorized detachment of the security tag assembly from the merchandise in a quick and easy manner and preferably, but not exclusively, as the merchandise is being purchased or otherwise removed from the outlet site in an authorized manner. However, removal of the security tag assembly by unauthorized personnel, such as when the merchandise is being displayed, cannot be easily accomplished.

More specifically, the various preferred embodiments of the security tag assembly of the present invention include at least one base and at least one attachment member connectable together in an operative position on the merchandise. However, as practically utilized, a plurality of bases and attachment members are utilized, such as when protecting and/or monitoring a plurality of products and/or merchandise, as is commonly practiced in many retail outlets. In at least one preferred embodiment of the present invention, each of a plurality of attachment members are structured to be disposable after use, upon being removed from a corresponding base and the merchandise being protected. Thereafter, a different, unused attachment member replaces the removed attachment member such as when new or different merchandise is to be protected. In contrast the one or more bases associated with the security tag assembly of the present invention are structured to include various structural and operative features which enable the reuse of each of the bases.

Additional features of various preferred embodiments of the present invention include the provision of at least one magnetomechanical member disposed on the base so as to be considered a part thereof. The at least one magnetomechanical member may comprise an elongated strip, band or ribbon of flexible material which may be more specifically defined by a magnetorestrictive structure having the aforementioned strip, band, and/or ribbon-like structural configuration. Further, the at least one magnetomechanical member may in the form of an amorphous metal.

In each of the preferred embodiments of the present invention, the magnetomechanical member is structured to assume an "armed" mode. As used herein, the armed mode of the magnetomechanical member comprises the ability of the at least one magnetomechanical member to demonstrate a mechanical resonance or vibration when it is exposed a resonant frequency, which may be predetermined.

Therefore when used, any attempt to steal or accomplish an unauthorized removal of the merchandise, without removing the aforementioned base and connecting member, will result in an alarm being activated. Such an alarm is of the type typically associated with surveillance, monitoring and/or alarm assemblies commonly found in retail outlets adjacent entrance and exit ways. More specifically, when the magnetomechanical member is in an armed mode, any attempt to pass through the monitoring and/or alarm system associated with an exit or entrance of the retail outlet will cause it being subjected to a natural resonant frequency. As such, the magnetomechanical member will demonstrate a mechanical resonance or vibration. This in turn will cause an alteration of magnetic fields associated with the monitoring and/or alarm system which in turn will activate an alarm.

As should be apparent, an activation of such an alarm will provide a clear indication that the security tag assembly of the present invention still remains in its operative position on the merchandise being removed. However, as intended an authorized removal or sale of the merchandise will involve the removal of the base, as well as the magnetomechanical member disposed thereon, by authorized personnel of the retail outlet. As such, the merchandise will freely pass through or in the proximity of the monitoring and/or alarm system without setting off any alarms. However, when more sophisticated individuals intend to steal the merchandise from the outlet, there may be attempts to orient the at least one magnetomechanical member into and "unarmed" mode. When unarmed, the magnetomechanical member will not demonstrate a mechanical resonance or vibration even when subjected to a range of monitoring frequencies, including a natural resonant frequency which would normally serve to activate an armed magnetomechanical member into a state of vibration. An unauthorized attempt to remove protected merchandise may involve subjecting the base of the security tag assembly to a high intensity or otherwise "disruptive" magnetic field in an attempt to disarm the magnetomechanical member. As set forth above, when disarmed, the security tag assembly of the present invention will be able to pass through and/or be within the proximity of a monitoring magnetic field associated with the alarm system without causing the alarm to be activated.

Accordingly, one feature of the present invention includes the provision of a stabilizing assembly disposed on the base and structured to maintain the magnetomechanical member in an armed mode or restore the magnetomechanical member to an armed mode even when it has been subjected to a disruptive magnetic field, as set forth above. In at least one preferred embodiment of the present invention, the stabilizing assembly comprises at least one stabilizing magnet. The stabilizing magnet is disposed within a predetermined proximity or range of the magnetomechanical member on the base of the security tag assembly. Moreover, the at least one stabilizing magnetic is structured to include sufficient magnetic field characteristics to maintain or restore the at least one magnetomechanical member to the armed mode when subjected to the aforementioned disruptive field. Therefore, a potential thief may believe that subjecting the magnetomechanical member to a disruptive magnetic field orients the magnetomechanical member into a disarmed mode. However, the disposition, structuring and operational features of the stabilizing assembly will serve to maintain or restore the magnetomechanical member into the armed mode thereby causing an alarm to be activated, during any attempt to remove the merchandise from the intended area in an unauthorized manner.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
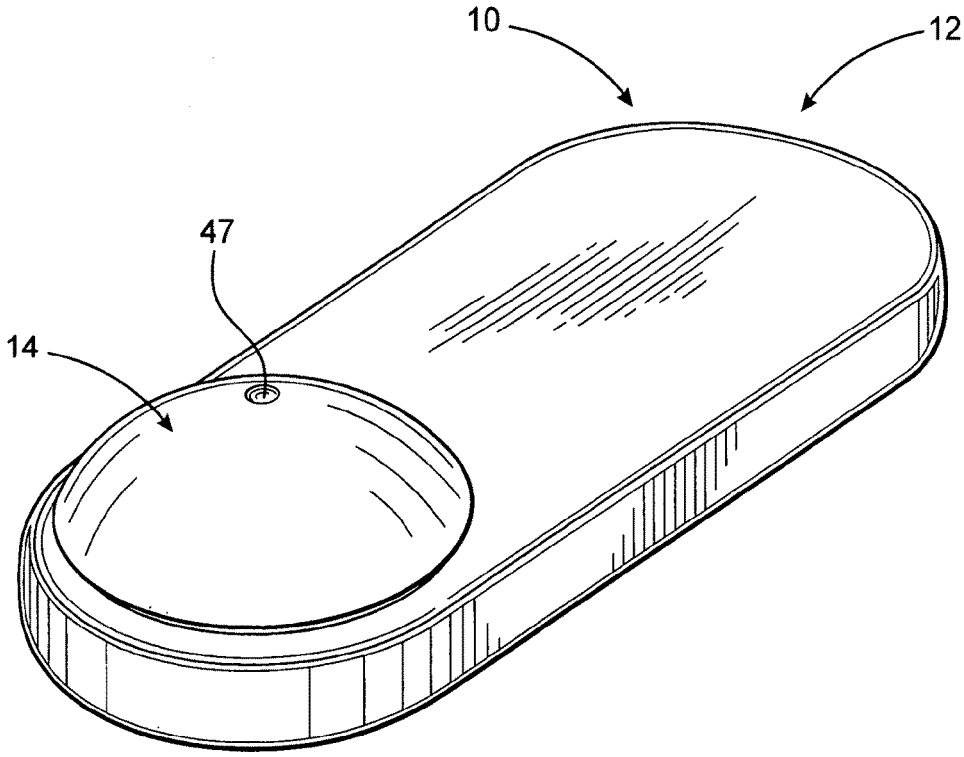
FIG. 1 perspective view of one preferred embodiment of the security tag assembly of the present invention.

As shown in the accompanying drawings, the present invention is directed to a security tag assembly generally indicated as 10 and comprising at least one base 12 and at least one attachment member 14. However, a practical application of the present invention would typically involve a plurality of bases 12 and a plurality of attachment members 14, such as when a plurality of different products were being protected and/or monitored. Moreover, the security tag assembly 10 is of the type structured to be removably secured to various types of merchandise 18 so as to prevent unauthorized removal of the merchandise 18 from a given area or location. Typical applications for the security tag assembly 10 of the present invention include the interconnecting of one base 12 and any one of a plurality of attachment members 14 to merchandise 18 being protected. As such, removal of the security tag assembly 10 from its operative position can be quickly and easily accomplished by authorized personnel utilizing approved techniques and/or hardware. To the contrary, separation of the base 12 and the attachment member 14 from the operative position and the protected merchandise is extremely difficult when attempted by unauthorized personnel.

Further, at least one preferred embodiment of the present invention comprises each of the plurality of attachment members 14 being structured to be disposable after use, subsequent to being removed from a corresponding base 12 and the merchandise being protected. In contrast, the one or more bases 12 of the security tag assembly 10 of the present invention include various structural and operative features which enable their repeated use. Such features include, but are not limited to, an indicator assembly and a connector member which allow any one of the bases 12 to be connected to any one of the "unused" attachment members 14, as will be described in greater detail hereinafter.

Figure 7:
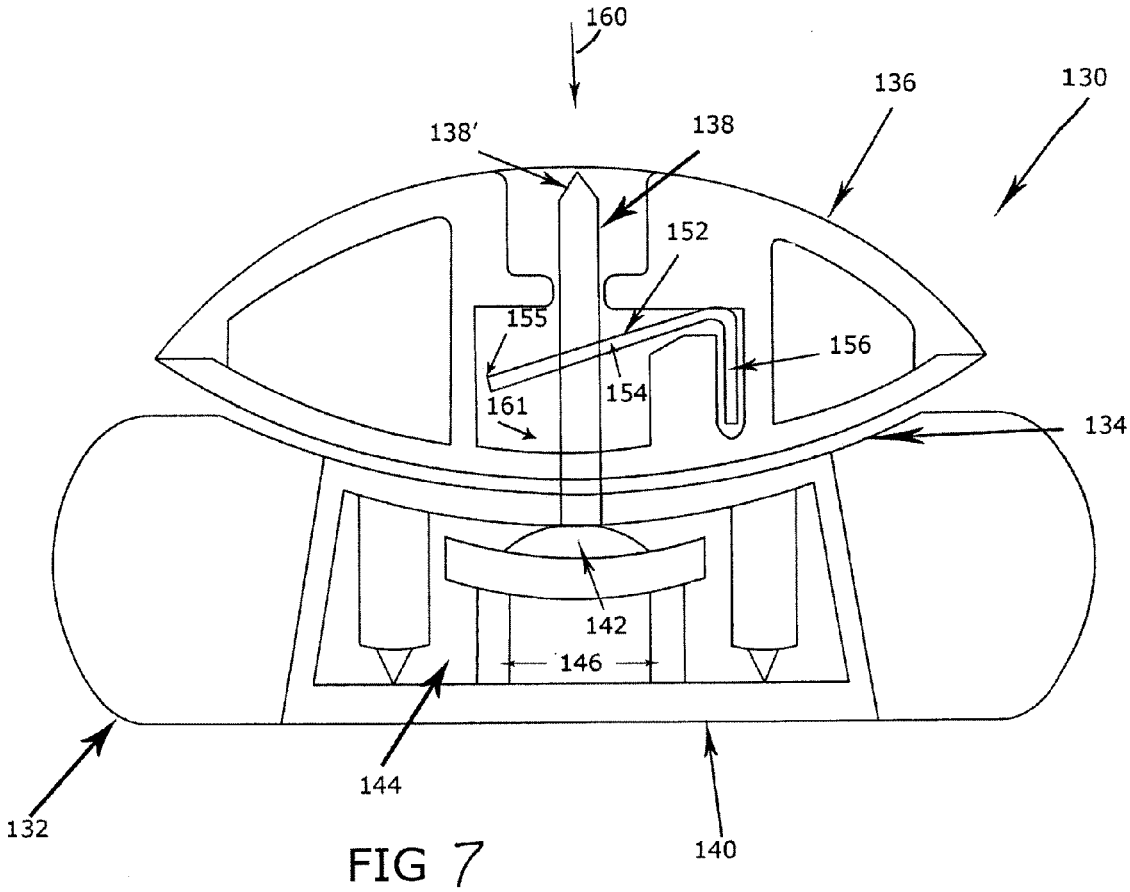
FIG. 7 is a sectional interior view of yet another preferred embodiment of the security tag assembly of the present invention.
Figure 8:
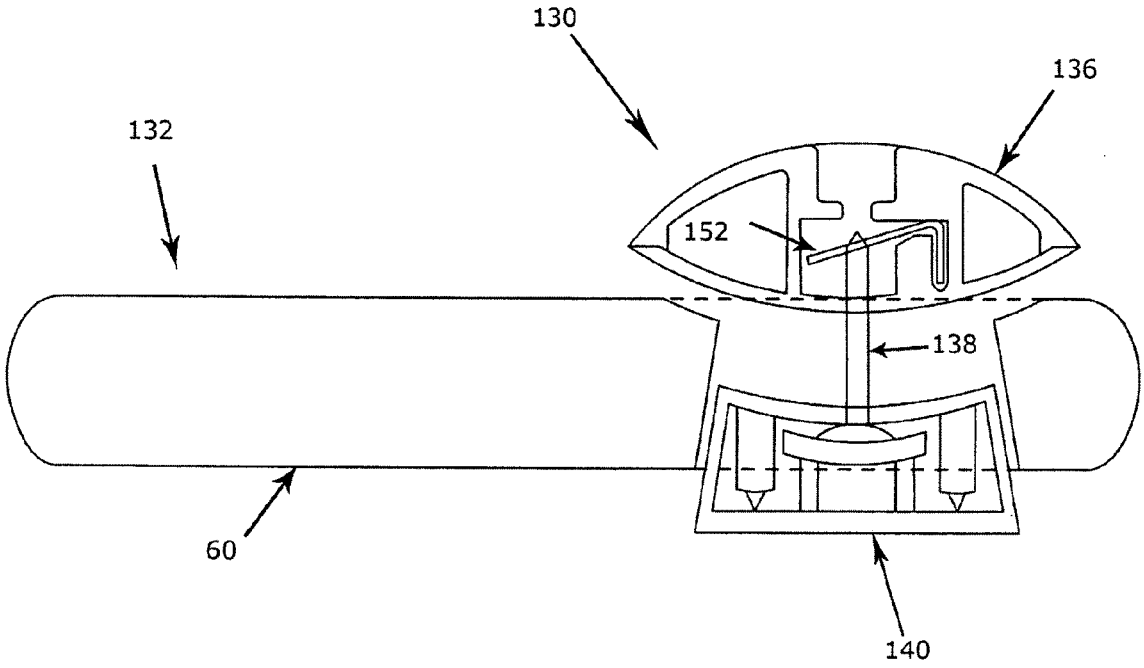
FIG. 8 is an exploded side view in section of the preferred embodiment of FIG. 7.

With primary reference to FIG. 7, yet another structural feature incorporated in at least one preferred embodiment of the present invention is the provision of a display field generally indicated as 60. The display field 60 is formed on any one of a plurality of different exterior surface portions of the base 12 such as on a rear or undersurface 62. The size and configuration of the display field 60 may vary and is at least partially dependent on the size, dimension and configuration of the base 12 as well as the intended informative data or information, generally indicated as 64, intended to appear thereon. The informative data 64 may include different information sections including a bar code, optical other electrically scanned indicia 66 and/or one or more plurality of printed data sections. The content of the predetermined information and/or data provided for viewing and external exposure would include merchandise information and/or other information regarding the origin, manufacture, distribution history, etc., associated with the merchandise 18 being protected. Other informative data may include physical characteristics of the merchandise or product 18 including size, color, material as well as the pricing thereof. The predetermined data or information, including such information identified as merchandise data is intended to be only representative of a variety of different information and/or data segments or portions which may appear in the display field 60.

Further, the predetermined data or information may be permanently, fixedly and/or removably secured within the display field 60 such as by a labeling and/or by an otherwise fixed and/or secured structuring extending over at least a portion of a corresponding surface 62. Also, the inclusion of the display field 60 can result in time and cost saving features, such as by connecting the security tag assembly 10 at the manufacturing site and thereby "identifying" the merchandise at this point in the product distribution system. By way of example, many products with which the security tag assembly 10 may be used are manufactured in locales having labor costs which are significantly lower than in the geographical location where the products are sold. Therefore, attachment of the security tag assembly 10, having the display field 60 and pertinent data 64 appearing thereon, at the manufacturing site, rather than at the retail outlet, could result in significant savings in labor costs, while assuring that the product is properly marked, described, identified, etc.

More specific structural details of the various preferred embodiments of the present invention include the base 12 having a generally elongated or other appropriate configuration. In addition, maintenance of the merchandise 18 in a clamped orientation between the base 12 and the attachment member 14 is further facilitated by a seat 20 disposed on the base. The seat 20 is preferably configured to correspond to the outer surface configuration 14' of the attachment member which is disposed in a substantially seated or aligned received relation within the seat 20. The structures of the preferred embodiments represented in the various figures include the seat 20 having a substantially concave configuration which corresponds to the substantially convex configuration 14' of the attachment member 14. Accordingly, when the base 12 and attachment member 14 are in the aforementioned and preferred operative position, the merchandise 18, depending upon its physical characteristics may be effectively clamped "within" the seat 20 between the base 12 and the outer surface portion 14' of the attachment member 14.

In order to maintain a secure interconnection between the base 12 and the one or more attachment members 14, the base 12 is provided with a connector member generally indicated as 22 comprising an elongated connector pin or like structure 24. The innermost end 26 of the pin is secured to the base 12 preferably, but not necessarily, in cooperation with the seat 20. Moreover, the length of the connector pin 24 is sufficient to extend outwardly from the seat 20 as well as a remainder of the adjacent exterior surface 12' of the base 12 so as to engage and be properly connected to the attachment member 14.

Figure 5A:
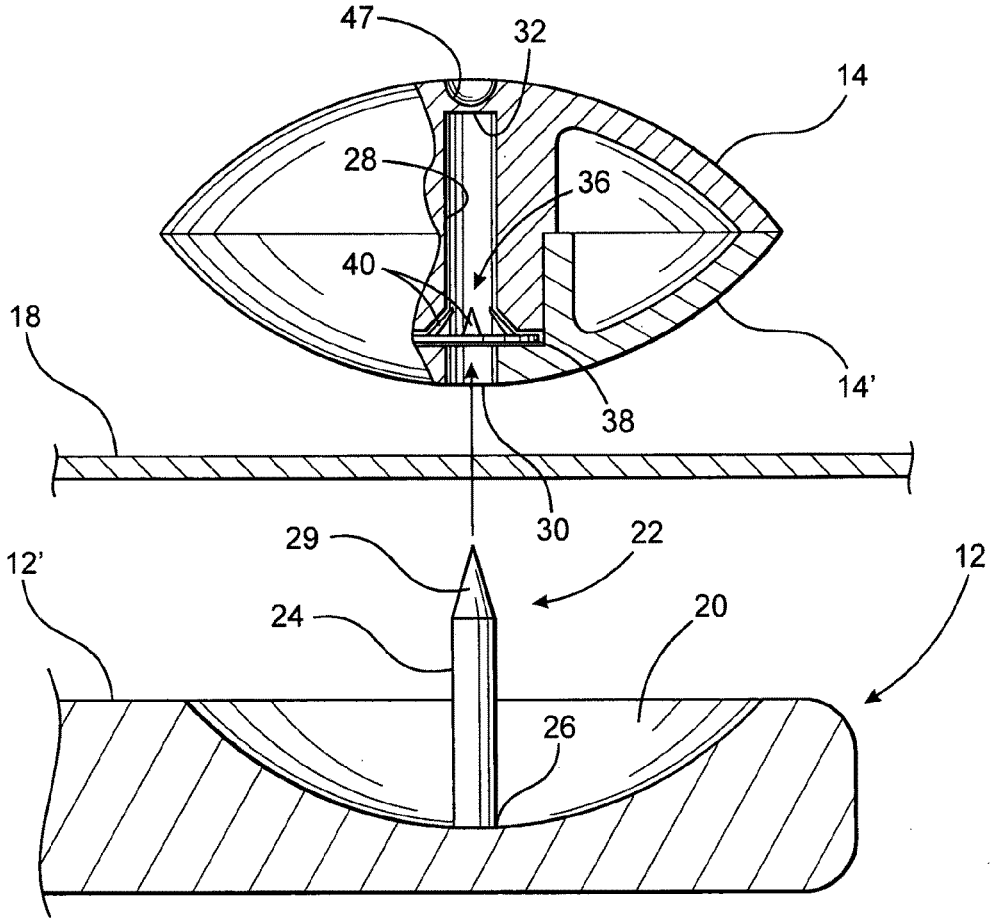
FIG. 5A is an exploded view in partial cutaway and section showing the relative positions of the various operative components for the embodiments of FIGS. 1 through 5D in an unassembled orientation.
Figure 5B:
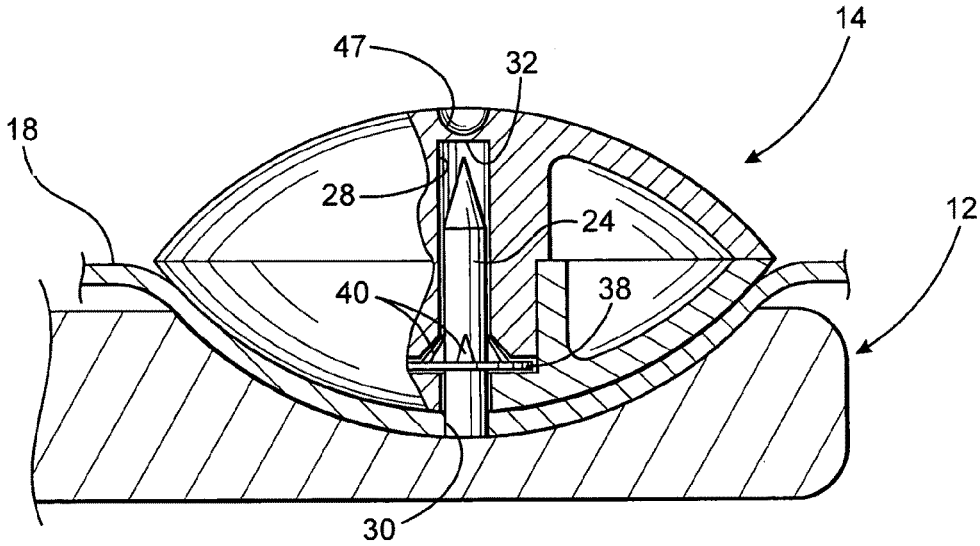
FIG. 5B is a sectional view in partial cutaway of the embodiment of FIG. 5A in an assembled orientation.
Figure 5C:
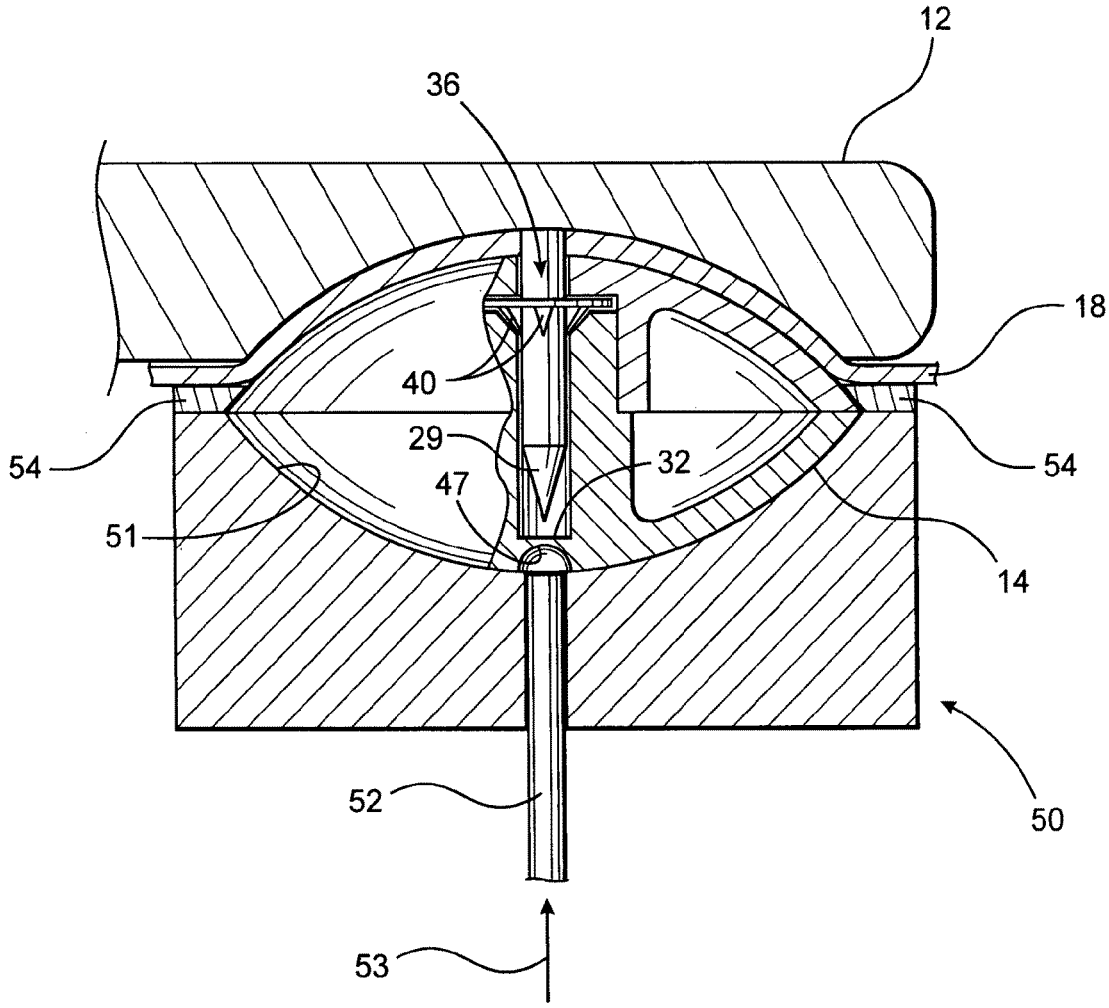
FIG. 5C is a sectional view in partial cutaway representing the separation of the operative components of the preferred embodiment of the present invention from that shown in FIG. 5B.

Cooperative structuring of each of the plurality of attachment members 14 includes an elongated passage or channel 28 disposed on the interior of the one or more attachment members 14. Moreover, the channel 28 has a proximal end 30, which is preferably open, as well as a distal end 32. Each of the proximal and distal ends, 30 and 32 respectively, are disposed contiguous with or immediately adjacent to opposed exterior surface portions of the one or more attachment members 14 as clearly demonstrated in FIGS. 5A through 5C. Therefore, the channel 28 extends substantially entirely along a transverse dimension of the attachment member, wherein such transverse dimension is at least partially defined by the location of the oppositely disposed proximal and distal ends 30 and 32, respectively, of the channel 28. The securing of the attachment member 14 in the preferred, operative position comprises penetration of the merchandise 18 by the connector pin 24 and continued travel of the connector pin 24 through the open proximal end 30 and into the interior of the channel 28 and along a substantial portion of the length thereof. Penetration of the merchandise 18 by the connector pin 24 as well as its passage into the channel 28 may further be facilitated by a pointed or other appropriately shaped tip 29, as demonstrated.

Additional structural features of the various preferred embodiments of the present invention include the provision of a locking assembly generally indicated as 36. The locking assembly 36 is disposed on or preferably within the interior of the attachment member 14 and/or at least in communication with the channel 28 and open end 30 so as to be disposed in receiving relation to the connector pin 24. Therefore, as the connector pin 24 is disposed within the channel 28, it will pass through the open proximal end 30 and be received by the locking assembly 36 as the pin 24 passes there through. One preferred embodiment of the locking assembly 36 comprises a ring 38 disposable in surrounding, concentric relation to the connector pin 24 when it is positioned within the interior of the channel 28 as clearly demonstrated in FIGS. 5B and 5C. In addition, the locking assembly 36 includes a plurality of spaced apart fingers 40 normally disposed in an outwardly angular orientation. As such outer portions of the plurality of fingers movably engage the connector pin 24 when it is disposed within the channel 28. Further, the structure, configuration, disposition and outwardly angular orientation of each of the plurality of fingers 40 is such as to allow inward travel of the connector pin 20 as it passes into the interior of the attachment member 14 along the channel 28. However, the structure of the plurality of fingers 40 is such as to restrict movement of the connector member 24 in the opposite direction or out of the channel 28, such as when the separation of the attachment member 14 and the base 12 is attempted. The locking assembly 36 can therefore be further described as being disposed and structured to movably engage the connector pin 24 such that it facilitates movement or passage thereof inwardly into the interior of the attachment member 14 along the channel 28. In contrast, the structure and orientation of the plurality of fingers 40 is such as to restrict movement of the connector pin in the opposite direction, out of the channel 28, such as when an attempt to disconnect the base 12 and the attachment member 14 from the intended operative position occurs.

As set forth above, one operative feature of the various preferred embodiments of the present invention includes the ability to easily and quickly remove the security tag assembly 10 from the merchandise 18 utilizing authorized personnel, techniques and/or hardware. To the contrary, unauthorized separation of the base 12 and the associated attachment member 14 is rendered extremely difficult when the proper procedures and/or hardware are not utilized. With primary reference to FIGS. 5*c*, and 5D, separation of the base 12 and the attachment member 14 from their intended operative position in clamping engagement with the merchandise 18 can be easily accomplished utilizing an approved or authorized detachment assembly, generally indicated as 50. The detachment assembly 50 is intended to be only representative of a variety of different devices and/or hardware which could be applied to the security tag assembly 10 and structured to separate the base 12 from the attachment member 14 and detach the merchandise 18 therefrom without causing damage to the base 12 or merchandise 18.

Accordingly, the detachment assembly 50 includes a cavity or like structure 51 (see FIGS. 5C and 5D) for receipt of an attachment member 14 therein when mounted on the detachment assembly 50 in the orientation disclosed. In addition, the detachment assembly 50 comprises a drive shaft 52 and a holding or stabilizing structure 54. Operation of the detachment assembly 50 causes a positioning of the stabilizing structure 54 into engagement with corresponding portions of the attachment member 14 and a forced movement of the drive shaft 52 into the interior of the attachment member 14, in accordance with directional arrow 53.

The force of the drive shaft 52 will cause a rupture, displacement, detachment and/or otherwise destructive removal of a cover member or portion 47 which overlies and therefore covers or closes the distal end 32 of the channel 28. The specific structuring of the cover member 47 may vary such as being attached in its intended, overlying position to the channel 28 by a weakened or serrated connecting portion. Alternatively, the material from which the attachment member 14, as well as the cover portion 47 is formed may be such as to yield under the linearly directed force exerted thereon by the drive shaft 52 as it travels into the attachment member 14.

Figure 5D:
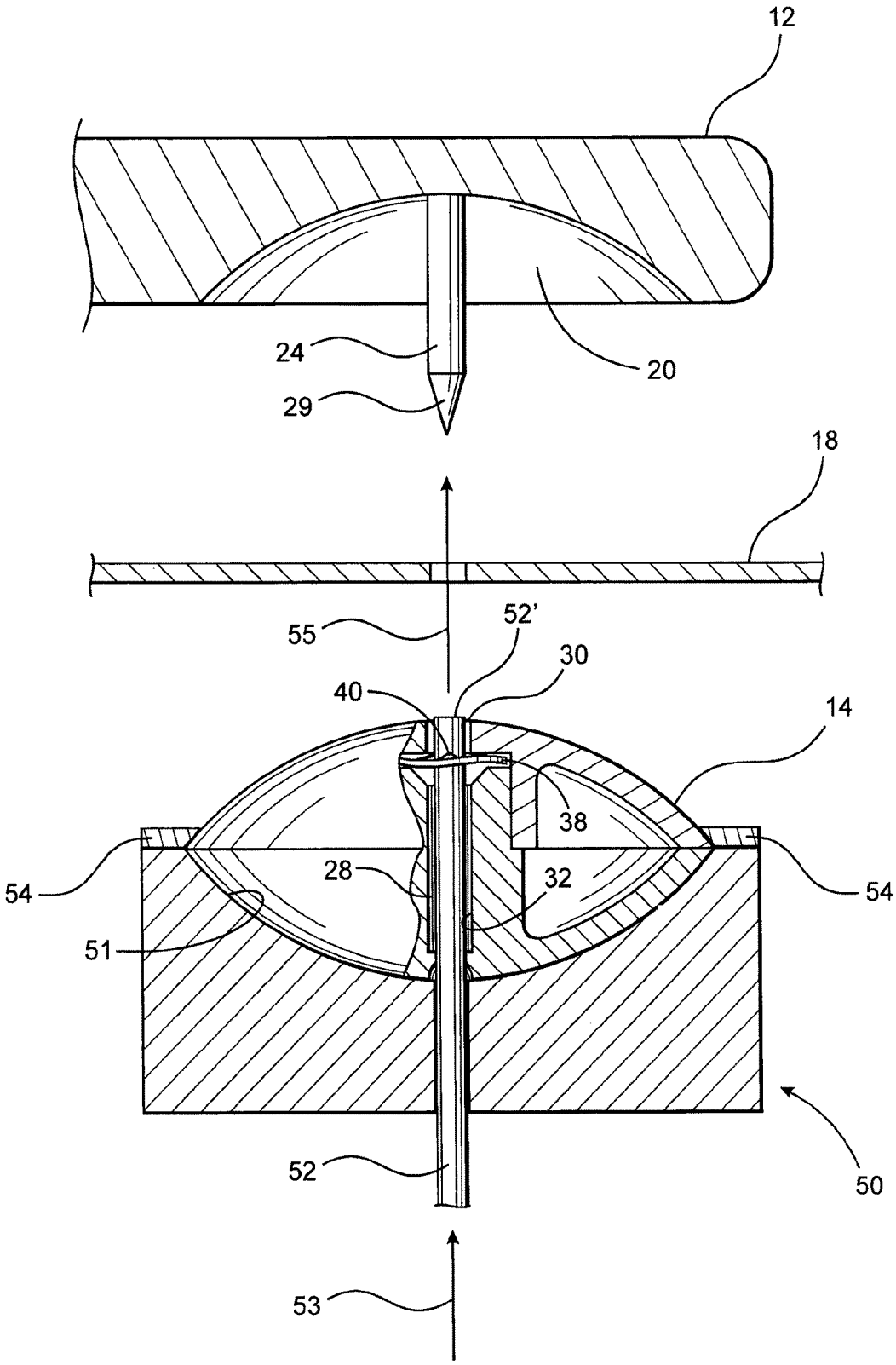
FIG. 5D is an exploded view in cross section and partial cutaway further representing the authorized operation of separating the various components from the position shown in the embodiment of FIG. 5B.
Figure 6:
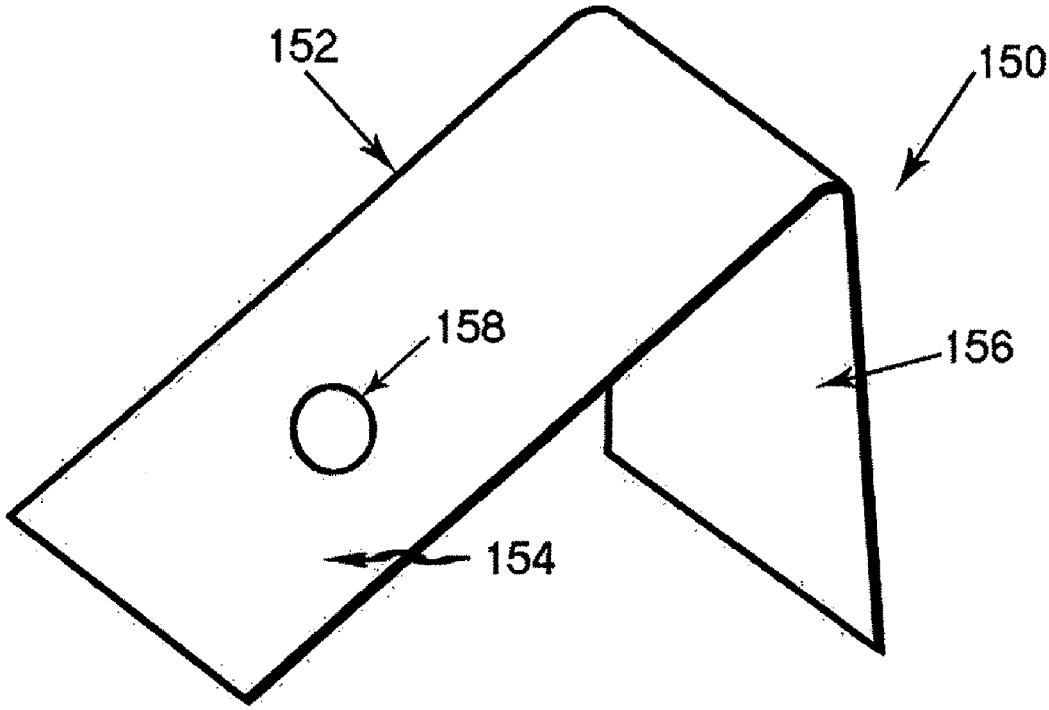
FIG. 6 is a detailed perspective view of another preferred embodiment of a locking assembly associated with the preferred embodiment of FIGS. 7 through 9.

Continued travel of the drive shaft 52 into the interior of the channel 28, through the distal end 32, results in an engagement between the extremity 52' of the drive shaft 52 and outer end portion 29 of the connector pin 24. As such, the continued travel and driving force of the drive shaft 52 will force the connector pin 24 out of the channel 28 and against the movement resisting engagement of the locking assembly 36 and the plurality of fingers 40. Also, disposition and structure of the locking assembly 36 including, but not limited to, the structure of the plurality of fingers 40 will cause a destruction, or at least partial deformation, of the locking assembly, as represented in FIG. 5D, as the connector pin 24 is forced outwardly from the channel 28 through the open end 30. Accordingly, the locking assembly 36 can be said to be "destructively detached" and/or displaced from a position relative to and engagement with the connector pin 24 as the pin 24 is forced outwardly from the channel 28 in the opposing direction to its direction of entry, as schematically indicated by directional arrow 55.

Once the base 12 and the attachment member 14 are separated from their intended operative position, connector pin 24 may also be easily removed from the merchandise 18. Therefore, the deformation or at least partial destruction of the locking assembly 36 will most probably render the associated attachment member 14 incapable of further use. Accordingly, the attachment member 14, once forcibly detached from the connector pin 24, such as in the manner described above, may be considered disposable. In contrast the base 12, as indicated above, can be repeatedly used by having others of a plurality of attachment members 14 independently connected thereto in the aforementioned and preferred operative position.

Figure 3:
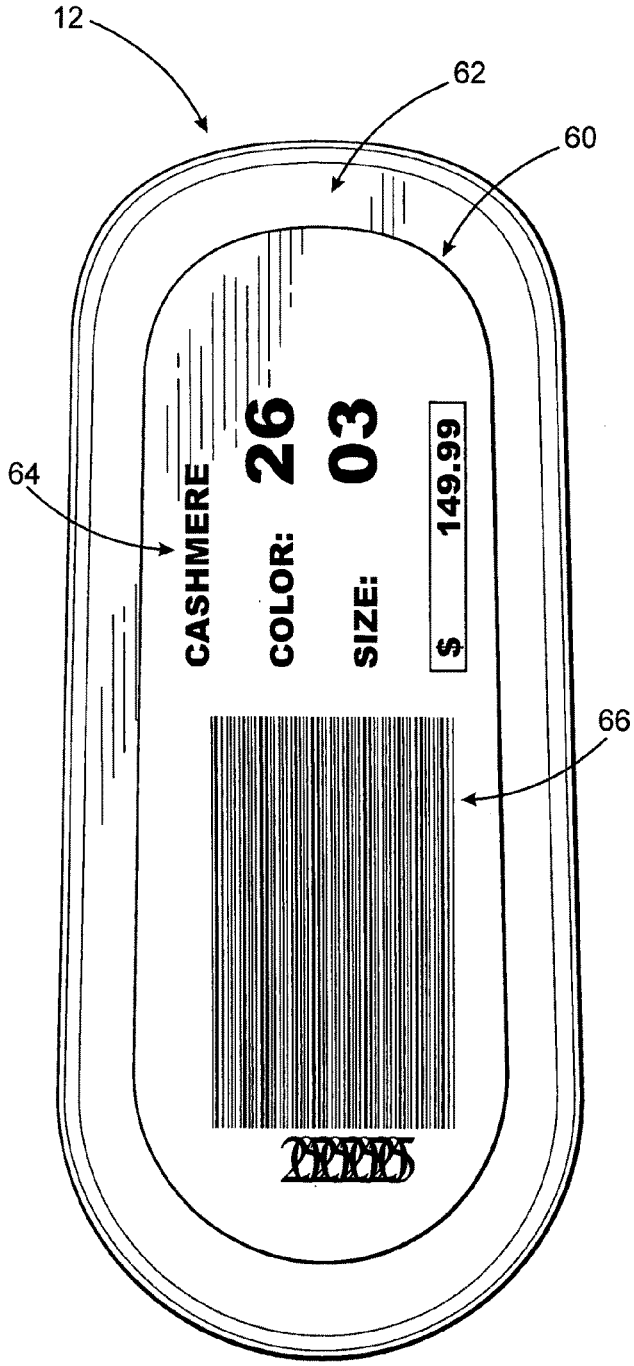
FIG. 3 is a bottom view of the embodiment of FIG. 1.
Figure 2:
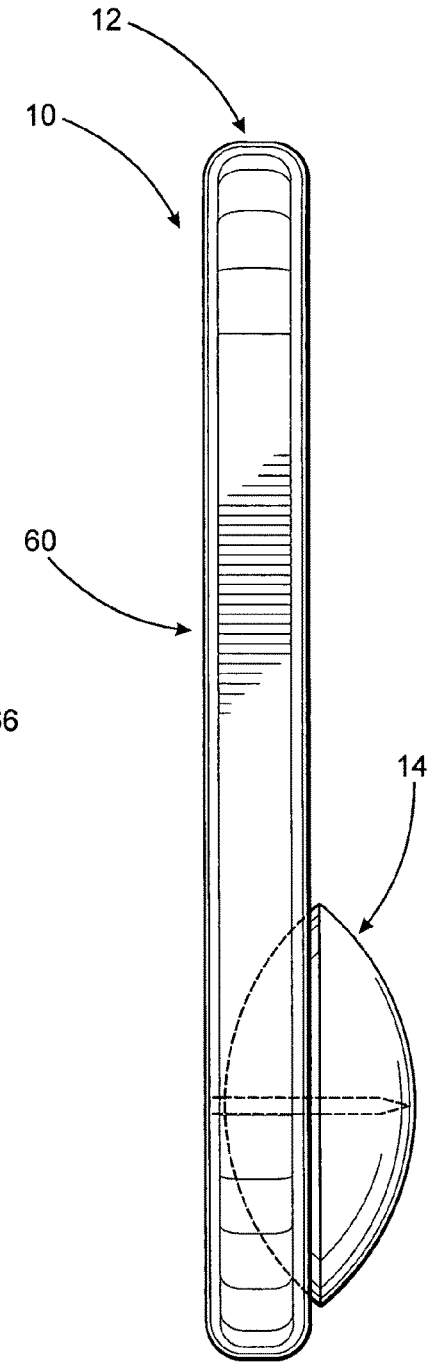
FIG. 2 is a right side view of the embodiment of FIG. 1.
Figure 4:
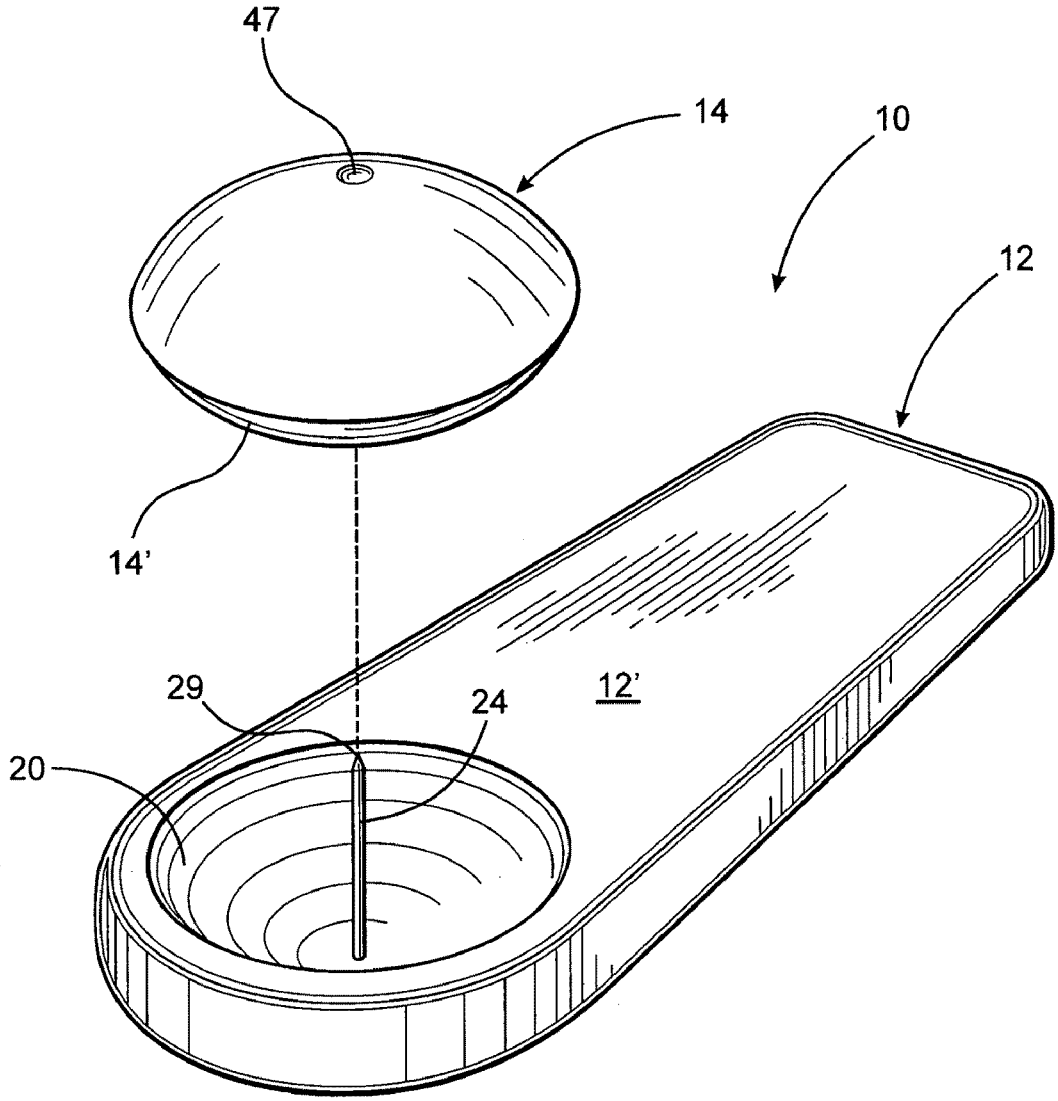
FIG. 4 is a perspective view in exploded form showing a separation of the various operative components of the embodiments of FIGS. 1 through 7.

With primary reference to FIGS. 6 through 9, yet another preferred embodiment of the security tag assembly of the present invention is generally indicated as 130. More specifically, the security tag assembly 130 is at least operationally similar to the embodiment of FIGS. 1 through 4, but at least structurally distinguishable there from. As such, the security tag assembly 130 comprises a reusable base 132 preferably including an elongated configuration or being otherwise structured and configured. The base 132 may include similar structural and performance features as the bases 12 including, but not limited to, an area 60 on an exteriorly exposed portion thereof. As such, the area 60 comprises merchandise data, as at 64 and 66, as described in detail with reference to FIG. 3.

Also, the reusable base 132 includes a substantially concave or other appropriately configured surface area 134 for the receipt of merchandise when the base 132 and an attachment member 136 is disposed in the operative position of FIG. 7. As also described above with regards to the embodiment of FIGS. 1 through 5D, when in the operative position, the base 132 and the attachment member 136 are connected to one another in clamped or otherwise attached relation to the merchandise. When so connected, the merchandise will substantially overlie the concave or other appropriately configured surface portion 134 of the base 132 and be positioned between the base 132 and the attachment member 136.

The security tag assembly 130 also includes an elongated, substantially pointed or sharpened connector member 138 disposed and structured to pass through or otherwise penetrate the merchandise being protected. The connector member 138 is secured to or connected to the base 132 and is more specifically attached to a mounting segment 140. Further distinguishing structural features of the connector member 138 and the base 132 comprise the rotational attachment or connection of the connector member 138 to the base 132. More specifically, the innermost end or head portion 142 of the connector member 138 is mounted on the interior of the mounting segment 140 and is rotatable within the chamber 144, such as by being rotationally disposed on a platform or like structure 146. As will be described in greater detailed hereinafter, the ability of the connector member 138 to rotate relative to both the base 132 and the mounting segment 140 further facilitates the inability to remove the attachment member 136 from the base 132, unless predetermined removal devices, including detachment assemblies 50 and/or 50', as well as other authorized detachment assemblies, are utilized.

Structural features of the security tag assembly 130 which are distinguishable from the embodiments of FIGS. 1 through 5D include the removable attachment of the mounting segment 140 to the base 132. As set forth above, the connector member 138 is connected directly to the mounting segment 140 and is interconnected to the base 132 thereby. As such, the connector member 138 can be removed with the mounting segment 140 from the remainder of the base 132 by separating or detaching the mounting segment 140 from the base 132, as schematically demonstrated in FIG. 8. This facilitates or allows the replacement, and disposal of the connector member 138 and mounting segment, while still allowing the remainder of the base 132 to be reused with different ones of a plurality of attachment members 136. It is also contemplated that the mounting segment 140 can be disposable and recycled under certain conditions.

Accordingly, the connector member 138 is movable both with and relative to the mounting segment 140 and therefore can be removable from the remainder of the base 132 possibly for repair but more likely for replacement. As set forth above, the connector member 138 is rotatable relative to the mounting segment 140 and accordingly rotational relative to the base 132 when the mounting segment 140 is secured to the base as represented in FIG. 7. Removable attachment of the mounting segment 140 to the remainder of the base 132 may be accomplished by any applicable means such as, but not limited to, a wedged, frictional engagement or by any other appropriate connecting or securing means. However, the mounting segment 140 is structured to remain in its attached position, as represented in FIG. 7, relative to the remainder of the base 132, as the attachment member 136 and the connector member 138 are detached from one another in an intended or authorized manner, as also disclosed in FIG. 8.

Figure 9:
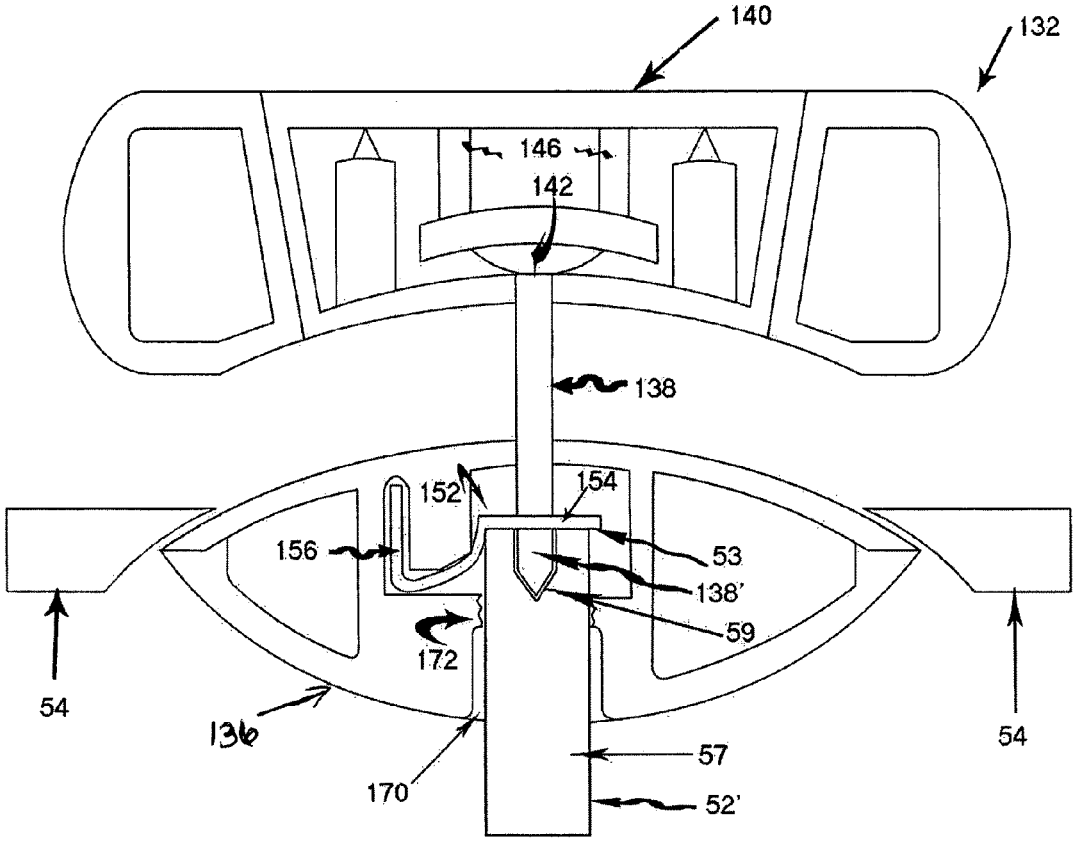
FIG. 9 is an interior sectional view in partial cutaway of the preferred embodiment of FIGS. 7 and 8.

Additional structural and operative features of the preferred embodiment of the security tag assembly 130 of the present invention is directed to the locking assembly generally indicated as 150 and shown in detail as FIG. 9. The locking assembly 150 comprises a substantially elongated locking member 152 including a first portion 154 and a second portion 156. The second portion 156 is substantially anchored in a fixed location on the interior of the attachment member 136 so as to at least partially provide stability and assure proper placement of the locking member 152. The locking member 152 is preferably formed from a flexible yet deformable material such as metal, plastic, etc. In addition, the at least initial configuration of the locking member 152 is such that first portion 154 is originally and normally disposed in what may be referred to as a first position. The first position, as demonstrated in FIGS. 6 through 9 comprises a skewed, angular orientation relative to the length or longitudinal axis of the connector member 138 when the locking member 152 is disposed in engagement therewith. Further, the first portion 154 includes an apertured construction comprising at least one opening or aperture 158 formed in the first portion 154. Accordingly, when the first portion 154 is in the first position and is angularly oriented, as set forth above, peripheral portions of the aperture or opening 158 is disposed in movement restricting engagement with the outer surface of the connector member 138.

In addition, the flexible nature of the locking member 152 allows the connector member 138 to initially pass into the interior of the attachment member 136 as the pointed or free end 138' of the connector member 138, passes through the aperture 158 of the first portion 154 of the locking member 152. As such, the attachment member 136 is easily disposable in its operative position and in clamping or otherwise secure engagement with the merchandise connected between the corresponding surfaces of the base 132 and the attachment member 136. However, attempts to withdraw or forcibly remove the connector member 138 out of the attachment member 136, in a direction schematically indicated by the directional arrow 160, will result in the free end 155 and a remainder of the first portion 154 being "pulled" or otherwise forced inwardly, generally in the direction schematically indicated by arrow 161. This will further assure a binding or movement restricting engagement between the periphery of the aperture 158 and the exterior surface of the connector member 138.

Also, because the connector member 138 is rotationally mounted on or connected to the base 132 and mounting segment 140, any attempt to remove the attachment member 136 from the base 132 by attempting to rotate the attachment member 136 relative to the base 132 will be ineffective. Moreover, because of the movement restricting engagement between the periphery of the aperture 158 of locking member 152 and the exterior surface of the connector member 138, attempted rotation of the attachment member 136 will serve to rotate the connector member 138 relative to the base 132. Therefore an individual will not be able to "unscrew" the attachment member 136 from the base 132 since the attachment member 136 and the connector member 138 are connected to and movable with one another by the locking member 152 and will rotate together relative to the base 132 and mounting segment 140.

With primary reference to FIG. 9, authorized removal of the attachment member 136 from the base 132, such as when the protected merchandise is being appropriately removed from a monitored area, may be accomplished by any of a plurality of detachment assemblies similar to that of detachment assembly 50. As set forth above, other devices, hardware, etc. may be utilized. However, one preferred structural modification comprises the drive shaft 52' having an at least partially hollow structure. As such, the interior of the free end 53 of drive shaft 52' is dimensioned and configured to enclose at least the pointed end 138' as well as an adjacent portion of the connector member 138. Also, the hollow interior of the open end 53 is preferably configured to substantially correspond to the pointed end 138' as indicated as 59 in FIG. 9. Accordingly, as the drive shaft 52' passes into the interior of the attachment member 136, the hollow interior of the free end 53 passes over and at least partially encloses the pointed end 138' of the drive shaft 52'.

Also, structural modifications of the attachment member 136 include a recess or opening 170 in the attachment member which has a sufficient transverse dimension to receive the distal, open end 53 of the drive shaft 52' in aligned, enclosing relation with the pointed end 138' and the remainder of the connector member 138. Further forced entry of the drive shaft 52' causes a breaking or destruction of at least a surrounding partition or like structural portion 172 by the distal open end 53. Upon entry, the end 53 engages and forcibly deflects or deforms the first portion 154 of the locking assembly 152. Moreover, the drive shaft 52' may be forced into deflecting engagement with the first portion 154 until the first portion 154 assumes a "flattened" or "sufficiently transverse" orientation relative to the connector member 138, as demonstrated in FIG. 9. This second position of the first portion 154 will result in the peripheral portions of the aperture 158 being disposed out of movement restricting engagement with the outer surface of the connector member 138.

Accordingly, the attachment member 136 can be removed from the connector member 138, as the drive shaft 52' forces the connector member 138 out of the interior of the attachment member, as should be apparent. It is to be noted, that the forced deflection and/or deformation of the first portion 154 into the second or "release" position should be such as to substantially "flatten" or otherwise orient the first portion 154 into a more "transverse orientation", rather than the skewed, angular orientation, as demonstrated in FIG. 7. The anchored positioning of the second portion 156 of the locking member 152 will provide sufficient stability to the locking member 152 so as to facilitate the forced deflection of the first portion 154 into the aforementioned second position, as represented in FIG. 9 and set forth above.

Figure 11:
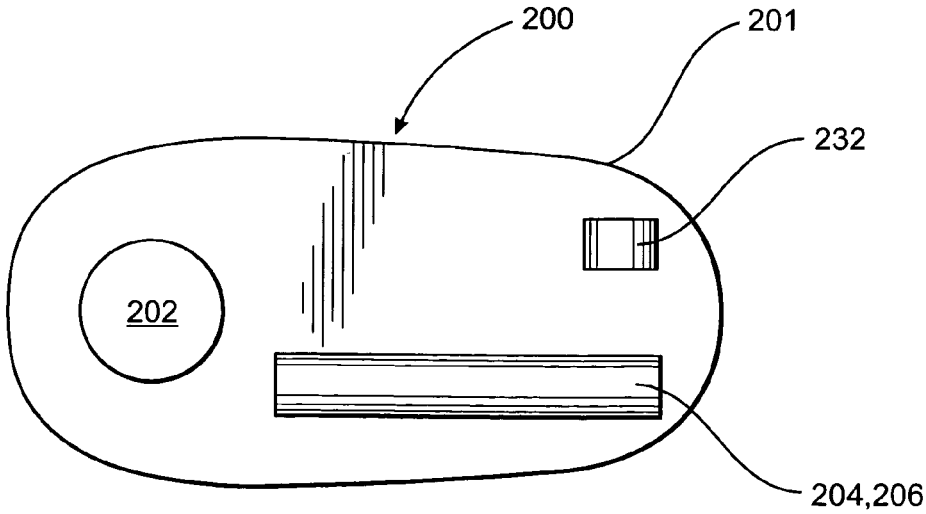
FIG. 11 is one preferred embodiment of a security tag assembly incorporating a magnetomechanical member structured to vibrate or assume a mechanical resonance when subjected to a normal or predetermined resonant frequency.
Figure 12:
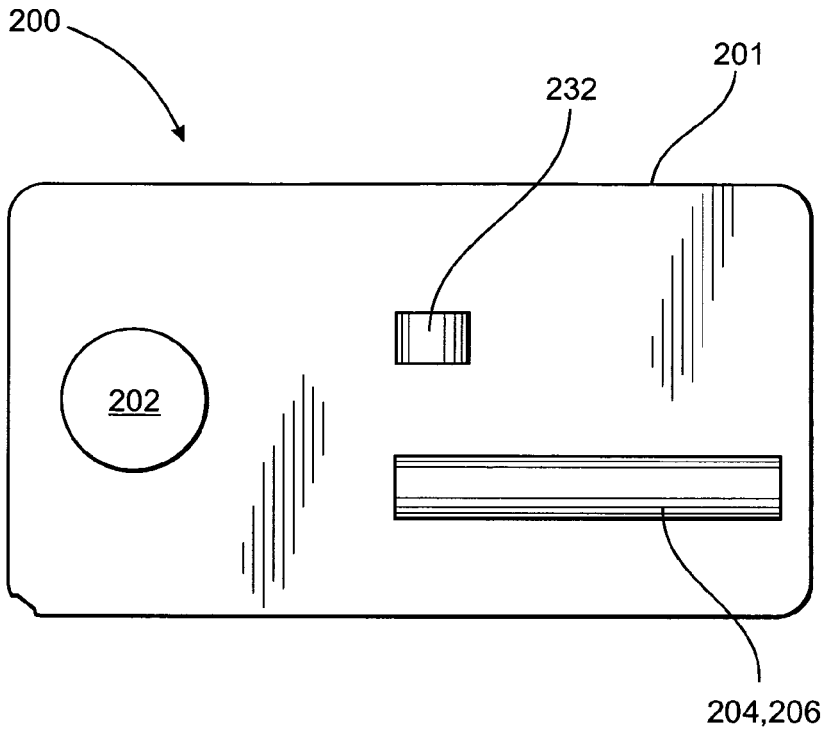
FIG. 12 is yet another preferred embodiment of a security tag assembly similar in operation to the embodiment of FIG. 11.
Figure 13:
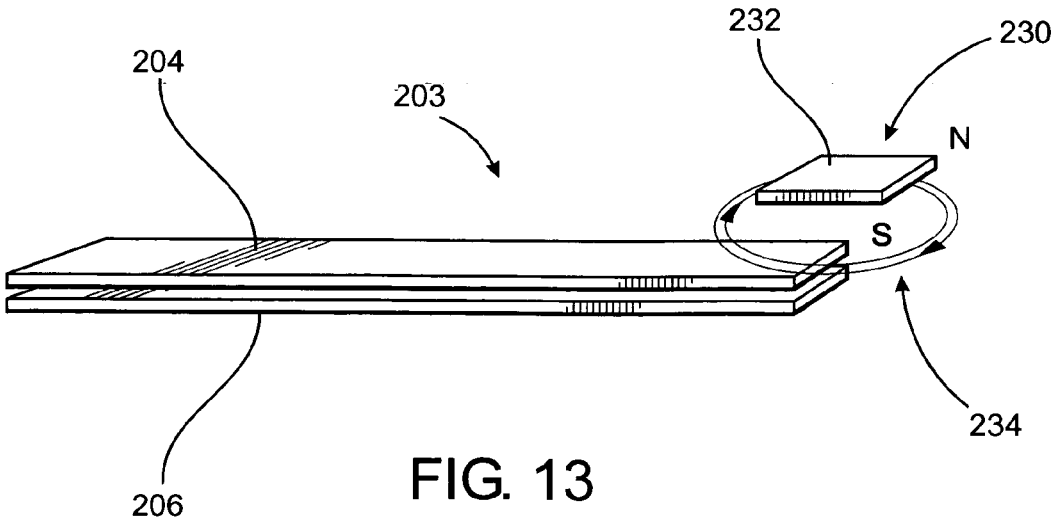
FIG. 13 is a schematic representation of details of a magnetomechanical assembly and a stabilizing assembly in the form of at least one stabilizing magnet associated therewith.

Another preferred embodiment of the present invention which may be used in combination with the embodiments of FIGS. 1-9, is represented in FIGS. 11-13. More specifically, this preferred embodiment comprises a magnetic security tag assembly 200 comprising a base 201 similar to the embodiments of FIGS. 1-9 and represented therein as 12 and/or 132. As generally demonstrated in FIGS. 11 and 12, the base 201 may assume a variety of different structures, dimensions and configurations. Further, the base 200 includes an attachment member 202, which is removably but operatively attached to the base 201 in the manner described in detail with reference to attachment member 14, in FIGS. 1-5D above. Further, an appropriate locking assembly of type represented in either FIG. 5A-5D or 6-9 may be utilized so as to restrict the removal of the attachment member 202 from the base 201 unless accomplished by authorized procedures, techniques and apparatus.

However, one distinguishing feature of the security tag assembly 200 from the embodiments set forth in FIGS. 1-9 is the provision of an alarm activating assembly 203 schematically represented in FIG. 13 and comprising at least one but in certain embodiments at least two magnetomechanical members 204 and 206. Each or at least one of the magnetomechanical members 204 and 206 is preferably formed or defined by a magnetorestrictive element, formed of a ferromagnetic material including, but not limited to, an amorphous metal. As such, the magnetomechanical members 204 and/or 206 are adapted, when oriented in an armed mode, to demonstrate a mechanical resonance or vibration when subjected or exposed to a predetermined frequency range, such as a predetermined resonant frequency.

Further, each of the one or more magnetomechanical members 204 and 206 may have a substantially elongated relatively thin ribbon, band, or like structure and a sufficient degree of flexibility and/or additional structural characteristics to facilitate the demonstration of a magnetic resonance or vibration, when it is exposed or subjected to the predetermined resonant frequency, as set forth above. Accordingly, the one or more magnetomechanical members 204 and 206, when in an armed mode, will cause an alarm to be activated thereby indicating an unauthorized removal of the merchandise to which the base 201 and attachment member are attached.

Figure 10:
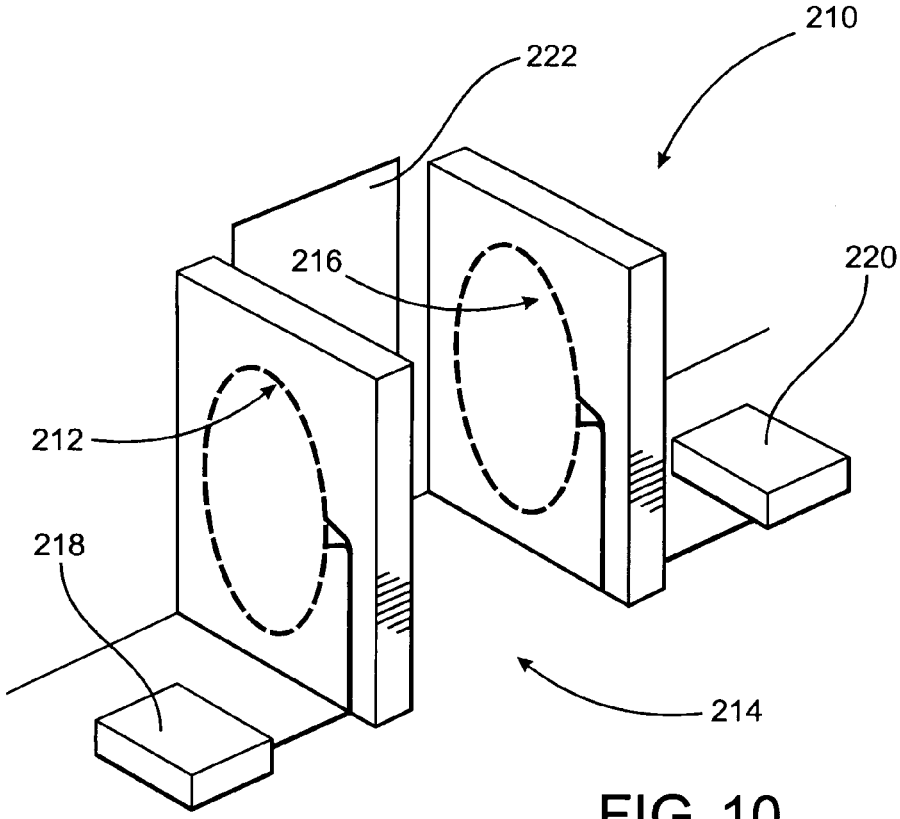
FIG. 10 (PRIOR ART)
FIG. 10 is a perspective view in partial schematic form representing prior art monitoring and/or alarm assemblies typically associated with the detection of an armed or activated magnetic tag assembly.

It is again emphasized, that the utilization of the various embodiments of the present invention involves the base 201 and associated attachment member 202 being operatively connected to merchandise being protected. However, when the merchandise is intended to be removed from a given site in an authorized manner, such as when being purchased, the base 201 and the attachment member 202 are detached from one another and the base 201 is removed from the merchandise. However, the one or more magnetomechanical members 204 and 206 will remain disposed on or within the base 201 in an armed mode since they will not be passing through any type of interrogation, monitoring or alarm system as generally indicated as 210 in the prior art representation of FIG. 10. Therefore, as long as the base 201, on which the one or more magnetomechanical members 204 and 206 are disposed, does not pass through the alarm system 210, there is no need to disarm the one or more magnetomechanical members 204 and 206.

For purposes of clarity, the monitoring and/or alarm system 210 may include any type appropriate power source such as an AC power source serving to activate a excitation coil 212 to create an electromagnetic field in an interrogation or monitoring zone generally indicated as 214. The coupling of this field into a receiving coil 216 is set to respond to any disruption of the magnetic field in the monitoring zone 214. As such, a transmitter as at 218 and a receiver and alarm as at 220 are appropriately disposed and connected to the excitation coil 212 and the receiving coil 216 in the manner demonstrated. Typically, such monitoring or alarm system 210 is disposed adjacent to or in sufficient proximity to an entrance or exit 222 to prevent any unauthorized removal of merchandise from an area associated with the exit or entrance 222. Accordingly, when the one or more magnetomechanical elements 204 and 206 are in an armed mode and pass into, through or in sufficiently close proximity to the monitoring zone 214, they will be exposed to a frequency range which includes a predetermined resonant frequency, such as a natural resonant frequency. This will result in a vibration of the magnetomechanical members, which in turn will cause an alteration of the coupling of the field between the excitation coil 212 and the receiving coil 216. Accordingly, an activation of the alarm 220, which may be audible, visually, etc., will occur. As such, there is a clear indication that an unauthorized removal of merchandise to which the base 201 is attached is being attempted.

In contrast, when the merchandise is being purchased an authorized removal of the base 201, as well as the one or more magnetomechanical members 204 and 206 attached thereto, from the merchandise is accomplished prior to it being exposed to the monitoring zone 214. Accordingly, as set forth above, there is no need to orient the one or more magnetomechanical members 204 and 206 into an unarmed mode. However, attempts to steal the merchandise to which the base 201, connecting member 202 and magnetomechanical members 204 and 206 are attached could include many deceptive practices or procedures directed to the deactivation of the alarm activating assembly 200 and the orientation of the one or more magnetomechanical members 204 and 206 in an unarmed mode.

By way of example, the base 201 may be subjected to a high intensity, externally disposed magnet in an attempt to generate a disruptive magnetic field. Such a disruptive magnetic field may include sufficient operative characteristics to alter the magnetic bias of the one or more magnetomechanical members 204 and 206, causing the unarmed orientation thereof. Accordingly, one operative and structural feature of a most preferred embodiment of the present invention is the provision of a stabilizing assembly generally indicated as 230. Further, the stabilizing assembly 230 preferably assumes at least one stabilizing magnet 232 disposed on the base 201 in a predetermined or sufficiently close proximity to the one or more magnetomechanical members 204 and 206 to exert a stabilizing force thereon. More specifically, the stabilizing force exerted by the one or more stabilizing magnets 232 is schematically demonstrated in FIG. 13 as a magnet field generally represented as 234. Therefore, the intensity of the generated, stabilizing magnetic field 234 by the one or more stabilizing magnets 232 is such as to positively influence the one or more magnetomechanical members 204 and 206. Such positive influencing by the stabilizing assembly 230 and stabilizing magnet(s) 232 includes the stabilizing magnetic field 234 being of sufficient intensity and being properly disposed and oriented to either maintain or restore the one or more magnetomechanical members 204 and 206 in the armed mode, even when subjected to a disruptive magnetic field from an unauthorized individual or source. The orientation, position and overall structuring of the stabilizing assembly 230, defined by the one or more stabilizing magnets 232, should be such as to accomplish maintenance of the one or more magnetomechanical members 204 and 206 in the armed mode. As set forth above, when so armed, the magnetomechanical member(s) 204 and 206 will demonstrate the aforementioned mechanical resonance or vibration when passing through the monitoring zone 214 of an appropriate alarm system 210, of the type represented in FIG. 10.

Further, the stabilizing assembly 230 and/or the one or more stabilizing magnets 232 may be include auxiliary or supplementary protective structuring and/or operative features, such as a shielding assembly 235 as schematically represented in FIGS. 11 and 12, which allow it to be operatively isolated from any externally applied disruptive magnetic field. Therefore, the stabilizing magnetic field 234 will be generated on a continuous or other appropriate basis sufficient to maintain or restore the one or more magnetomechanical members 204 and 206 in or to the armed mode as intended. As a result, if an individual fails to remove the base 201 from the merchandise and also fails to disarm the one or more magnetomechanical members 204 and 206, the alarm 220 will be activated as the one or more magnetomechanical members 204 and 206 assume the mechanical resonance or vibration due to exposure to the interrogation or monitoring magnetic field generated through the cooperative structuring and placement of the excitation coil 212 and the receiving coil 216.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security tag assembly structured to discourage unauthorized removal of merchandise from a given area, said security tag assembly comprising:

a base structured to be removably connected to the merchandise, an alarm activating assembly comprising at least one magnetomechanical member operatively oriented in an armed mode, said armed mode defined by a mechanical resonance of said one magnetomechanical member when exposed to a predetermined resonant frequency, a stabilizing assembly comprising at least one stabilizing magnet disposed on said base in spaced relation to said alarm activating, and said one stabilizing magnet disposed and structured to expose said one magnetomechanical member to a magnetic field of sufficient strength to restore or maintain said one magnetomechanical member in said armed mode upon exposure of said one magnetomechanical member to a disruptive magnetic field.

2. A security tag assembly as recited in claim 1 wherein said disruptive magnetic field is generated at a frequency other than said predetermined resonant frequency.

3. A security tag assembly as recited in claim 1 wherein said at least one stabilizing magnet, is disposed and structured to substantially continuously influence said magnetomechanical member into said armed mode.

4. A security tag assembly as recited in claim 3 further comprising a shielding assembly associated with said stabilizing assembly and structured to restrict a derogatory influence of a disruptive magnetic field on said one stabilizing magnet.

5. A security tag assembly as recited in claim 4 wherein said disruptive magnetic field is generated at a frequency other than said resonant frequency.

6. A security tag assembly as recited in claim 1 further comprising an attachment member removably connected to said base and a connector member disposed and structured to removably interconnect said base and said attachment member to the merchandise in an operative position.

7. A security tag assembly as recited in claim 6 further comprising a locking assembly disposed on said attachment member in locking engagement with said connector when said base and said attachment member are in said operative position.

8. A security tag assembly structured to discourage unauthorized removal of merchandise from a given area, said security tag assembly comprising:

a base structured to be connected to the merchandise, an alarm activating assembly comprising at least two magnetomechanical members operatively oriented into an armed mode, said armed mode defined by a mechanical resonance of said two magnetomechanical members when exposed to a magnetic field at a natural resonant frequency of said magnetomechanical members, a stabilizing assembly including at least one stabilizing magnet connected to said base within a spaced, influencing range of said two magnetomechanical members of said alarm activating assembly, and said one stabilizing magnet disposed and structured to expose said magnetomechanical members to a magnetic field having sufficient operative characteristics to facilitate maintenance of said two magnetomechanical members in said armed mode when exposed to a disruptive magnetic field.

9. A security tag assembly as recited in claim 8 further comprising said two magnetomechanical members each defined by an elongated flexible ribbon formed of a magnetorestrictive, ferromagnetic material.

10. A security tag assembly as recited in claim 9 wherein said magnetorestrictive ferromagnetic material comprises an amorphous metal.

11. A security tag assembly as recited in claim 8 wherein said disruptive magnetic field is generated at a frequency other than said predetermined resonant frequency.

12. A security tag assembly as recited in claim 8 further comprising a protective structure associated with said stabilizing assembly, said protective structure disposed and structured to restrict a derogatory influence of a disruptive magnetic field on said one stabilizing magnet.

* * * * *